US005488740A

United States Patent [19]

Garza

[11] Patent Number: 5,488,740

[45] Date of Patent: Feb. 6, 1996

[54] REVERSIBLE AND SIZE ADJUSTABLE HAT

[75] Inventor: Irene E. Garza, San Antonio, Tex.

[73] Assignee: Texace, San Antonio, Tex.

[21] Appl. No.: 397,894

[22] Filed: Mar. 3, 1995

[51] Int. Cl.[6] ..... A42B 1/22

[52] U.S. Cl. ..... 2/175.1; 2/195.3; 2/209.11; 2/DIG. 2

[58] Field of Search ..... 2/171, 175.1, 175.2, 2/181, 183, 195.2, 209.11, 209.12, DIG. 2, 195.1, 195.3, 195.4, 195.5, 195.6, 417, 418

[56] References Cited

U.S. PATENT DOCUMENTS

| | | | |
|---|---|---|---|
| 1,111,659 | 9/1914 | Le Pierre | 2/175.1 |
| 1,557,280 | 10/1925 | Watson | 2/175.1 |
| 2,052,123 | 8/1936 | Adamson | 2/181 |
| 4,551,859 | 11/1985 | Gerhardt | 2/181 |
| 5,181,277 | 1/1993 | Sherman | 2/195.2 |
| 5,428,843 | 7/1995 | Clowers et al. | 2/183 |

*Primary Examiner*—Diana Biefeld
*Attorney, Agent, or Firm*—Donald R. Comuzzi; Christopher L. Makay

[57] ABSTRACT

A reversible hat includes a first crown portion and a second crown portion stitched to the first crown portion. A first brim section is stitched to a second brim section with a brim stiffener stitched therebetween. The first brim section stitches to the first crown portion, while the second brim section stitches to the second crown portion. An elastic band permits the expansion of the first and second crown portions to allow the reversible hat to fit the head of any wearer.

4 Claims, 3 Drawing Sheets

REVERSIBLE AND SIZE ADJUSTABLE HAT

BACKGROUND OF THE INVENTION

1. Field of the Invention

The present invention relates to headwear and, more particularly, but not by way of limitation, to headwear that is fully reversible to provide two hats in one.

2. Description of the Related Art

Reversible hats provide versatility from headwear without the necessity of purchasing numerous colors and styles. For example, U.S. Pat. No. 1,538,847 which issued May 19, 1925 to Wheeler discloses a reversible sailors hat. The reversible sailors hat includes two hats lying inside of the other with each hat having a crown and a brim secured edge to edge with the crown by a seam. The two hats stitched together are of different colors so that a wearer will have the option of different hat colors from a single hat.

U.S. Pat. No. 3,187,345 which issued Jun. 8, 1965 to Holford discloses a cone shaped reversible hat. The hat consists essentially of two sector-shaped pieces of material that may be of the same color, complimentary colors, or contrasting colors. The hat may be quickly and easily reversed and/or styled in a variety of different ways to greatly increase the usefulness of the hat and its adaptability to be worn with a variety of different clothes.

Reversible hats also provide a wearer with different colors to serve a functional purpose. U.S. Pat. No. 1,816,346 which issued Jul. 28, 1931 to Silverstein discloses a reversible cap used primarily for hunting. The cap includes an angular head and circling band disposed between a crown portion and a peak. The cap further includes a flap for covering the ears and back of the neck. In one position, the cap displays a khaki or camouflage material so that the hunter blends in with the background. Alternatively, in its reversed position, the cap displays a bright red or orange material to make the hunter highly visible thereby helping to prevent hunting accidents.

U.S. Pat. No. 4,716,599 which issued Jan. 5, 1988 to Bell discloses a reversible cap used as a navigational aid. The cap includes a flexible crown portion, a head encircling band portion extending about the open side of the crown portion and a visor portion supported and projecting forwardly from the front marginal portion of the head and circling band portion. The inner and outer surfaces on opposite sides of a vertical front to rear extending plane bisecting the hat are of different colors with the color of the inner and outer surfaces of the cap on a first side of the aforementioned plane are red and inner and outer surfaces of the hat on the other side of the plane are black. The outer and inner surfaces of the forward crown portion of the cap include indicia indicating upstream and downstream directions, respectively, the downstream direction being disposed for viewing by a person portioned to the front of the cap when the cap is worn with the red side thereof to the left of the wearer.

Although the above-described reversible hats provide adaptability to allow wearing with a variety of different clothes and in some instances provide a functional use, they fail to include the versatile feature of one size fits all. Consequently, a fully reversible hat that may be worn by a wearer having any hat size would improve over the above-described reversible hats.

SUMMARY OF THE INVENTION

In accordance with the present invention, a reversible hat in a first embodiment includes a first crown portion and a second crown portion stitched to the first crown portion. A first brim section is stitched to a second brim section with a brim stiffener stitched therebetween. The first brim section stitches to the first crown portion, while the second brim section stitches to the second crown portion. An elastic band stitches to one of the first and second brim sections and resides between the first and second crown portions to permit an expansion of the first and second crown portions that allows the reversible hat to fit the head of any wearer.

A reversible hat in a second embodiment includes a first crown portion and a second crown portion stitched to the first crown portion. A first brim section is stitched to a second brim section with a brim stiffener stitched therebetween. The first brim section stitches to the first crown portion, while the second brim section stitches to the second crown portion. The first and second crown portions include a cut-out segment with an elastic band stitched therebetween to permit an expansion of the first and second crown portions that allows the reversible hat to fit the head of any wearer.

It is, therefore an object of the present invention to provide a reversible hat that includes a one size fits all feature.

Still other objects, features, and advantages of the present invention will become evident to those skilled in the art in light of the following.

DETAILED DESCRIPTION OF THE PREFERRED EMBODIMENTS

Figure 1:
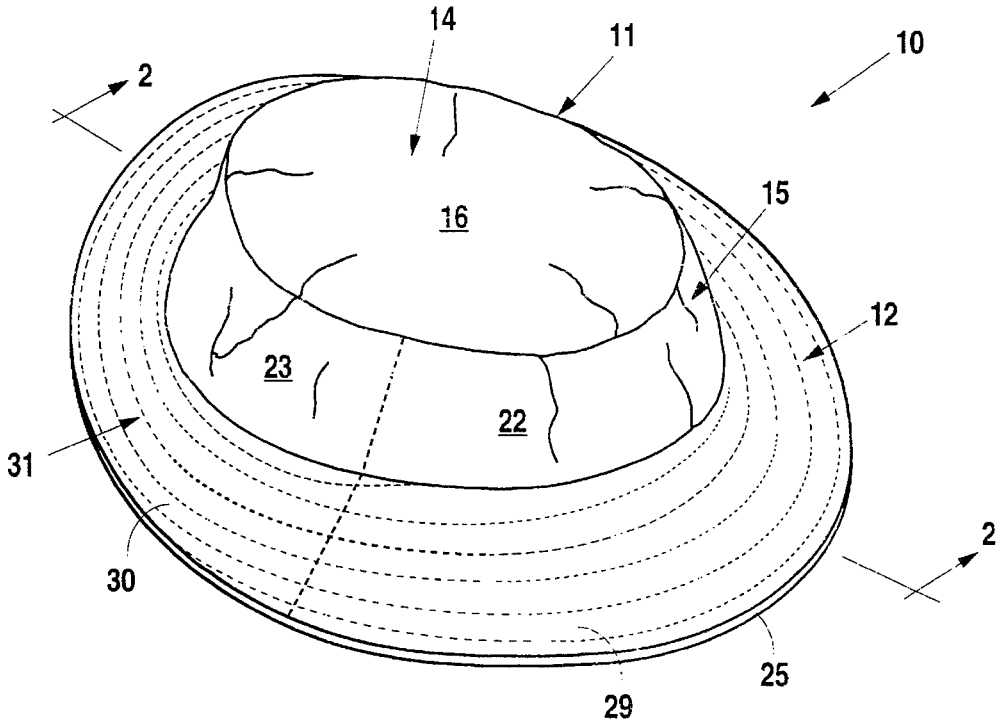
FIG. 1 is a perspective view illustrating a reversible hat of a first embodiment.
Figure 2:
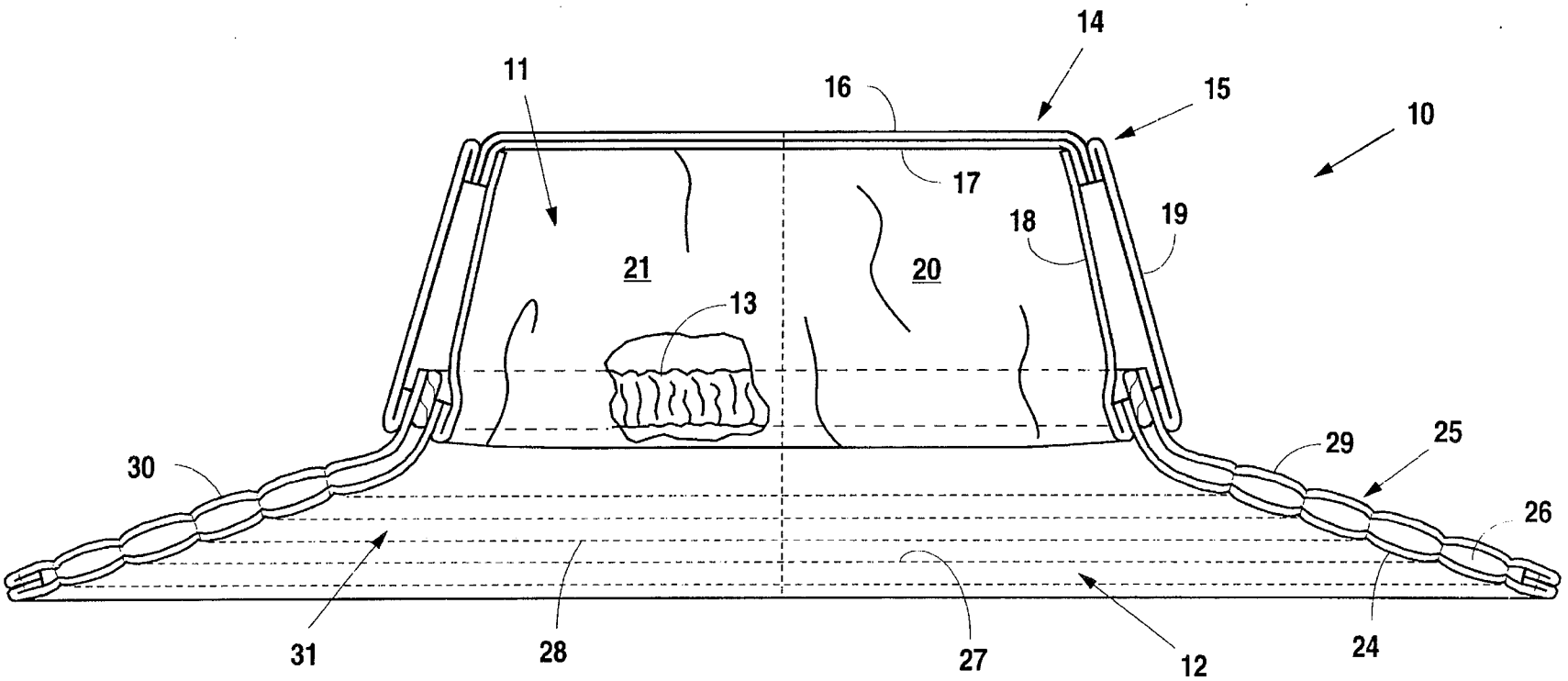
FIG. 2 is a side plan view taken in cross-section along lines 2,2 illustrating the reversible hat of the first embodiment.

As illustrated in FIGS. 1 and 2, reversible hat 10 of the first embodiment includes crown 11, brim 12, and elastic band 13. In this first embodiment, crown 11 and brim 12 are fashioned from any suitable material such as cloth, while elastic band 13 may be any flexible rubber band-like material.

Crown 11 includes tip 14 and cover 15. Cover 15 includes cover portion 18 which is formed from cover sections 20 and 21 (see FIG. 2) and cover portion 19 which is formed from cover sections 22 and 23 (see FIG. 1). To fashion cover 15, the ends of cover sections of 20 and 21 are stitched together to form cover portion 18 which has a circular shape. Similarly, the ends of cover sections 22 and 23 are stitched together to form cover portion 19 which also has a circular shape. Cover portions 18 and 19 are typically of a different color because hat 10 is designed to be reversible.

After forming cover portions 18 and 19, tip 14 is formed by stitching tip sections 16 and 17 together. Although not necessary, tip section 17 is typically the same color as cover portion 18, while tip section 16 is the same color as cover portion 19.

To form crown 11, cover portion 18 is first stitched to the edges of tip 14 on the side of tip 14 including tip section 17. Next, cover portion 19 is stitched to the edge of tip 14 on the side of tip 14 including tip section 16. After cover portions 18 and 19 are stitched to the respective tip sections 17 and 16, they are turned inside out over tip 14 to place the stitching and excess material to the interior of crown 11 as shown in FIG. 2.

Brim 12 includes brim sections 24 and 25 having brim stiffener 26 therebetween. In this first embodiment, brim stiffener 26 is a filler material sold under the trademark PELLON. Brim portions 27 and 28 are stitched together to form brim section 24 which may be circularly or oval shaped (see FIG. 2). Similarly, brim portions 29 and 30 are stitched together to fashion brim section 25 which also may be circularly or oval shaped. Typically, although not necessary, brim section 24 is the same color as tip section 17 and cover portion 18, while brim section 25 is the same color as tip section 16 and cover portion 19.

Brim 12 is fashioned by first stitching brim stiffener 26 to the outer edge of brim section 24. Next, brim section 25 is stitched to both brim stiffener 26 and brim section 24 along their outer edges. After the outer edges of brim sections 24 and 25 and brim stiffener 26 have been stitched together, brim sections 24 and 25 are turned inside out to place the stitching to the interior and place brim stiffener 26 therebetween as shown in FIG. 2. Finally, concentric rows of stitching referenced generally with numeral 31 are stitched into brim 12 to firmly secure and seal brim sections 24 and 25 together with brim stiffener 26 secured therebetween.

After the fashioning of brim 12, cover portion 18 of crown 11 is stitched to brim section 24 of brim 12 along the inner edge of brim section 24. Elastic band 13 is then stitched to brim section 25 along the inner edge of brim section 25. Reversible hat 10 includes elastic band 13 to provide a one size fits all feature. Consequently, a person may wear reversible hat 10 regardless of hat size because elastic band 13 will expand to fit a wearer of any range hat size. After the stitching of elastic band 13 to the inner edge of brim section 25, cover portion 19 is placed over brim section 25 such that it hides elastic band 13. Cover portion 19 is then stitched to brim section 25 to complete the fashioning of reversible hat 10.

Figure 3:
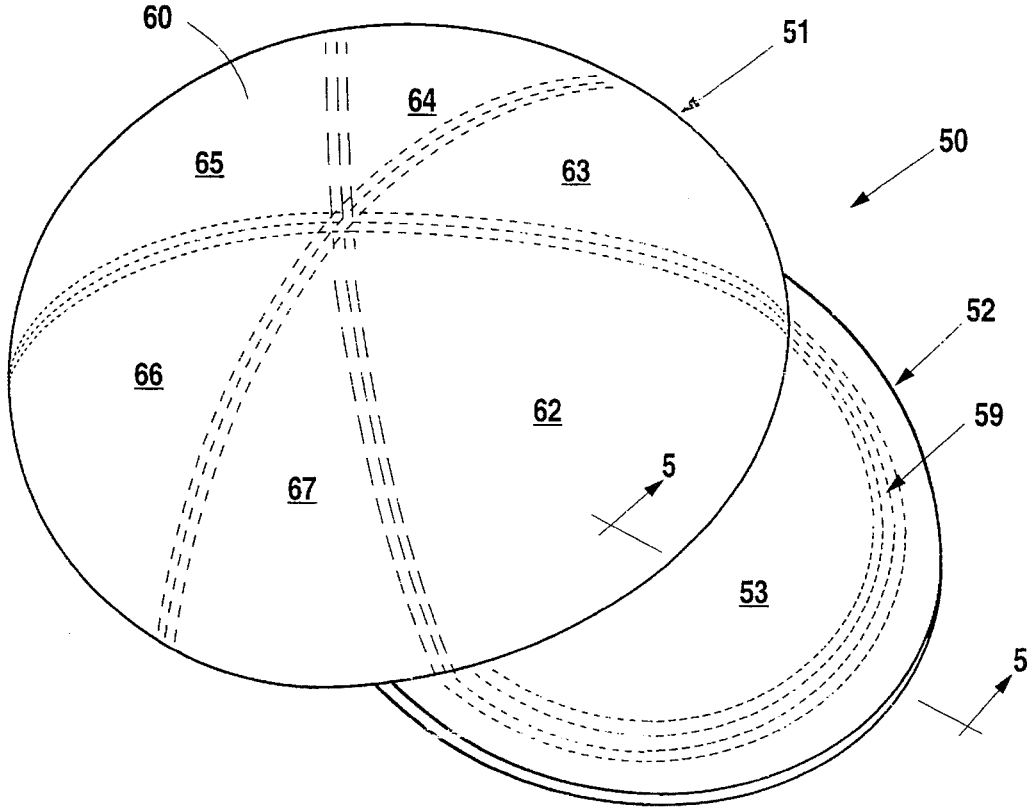
FIG. 3 is a perspective view illustrating a reversible hat of a second embodiment.
Figure 4:
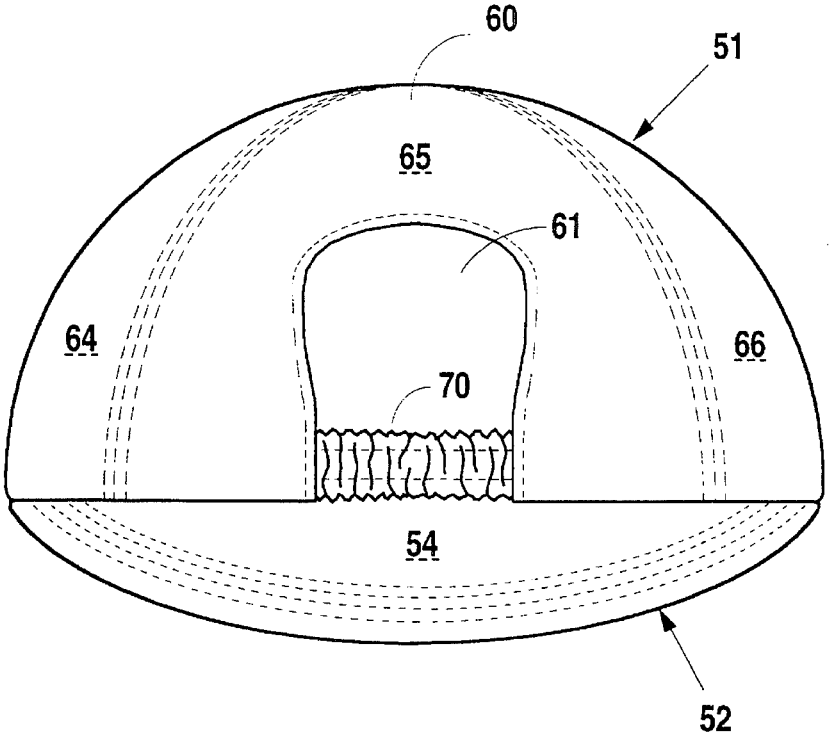
FIG. 4 is a rear plan view illustrating the reversible hat of the second embodiment.
Figure 5:
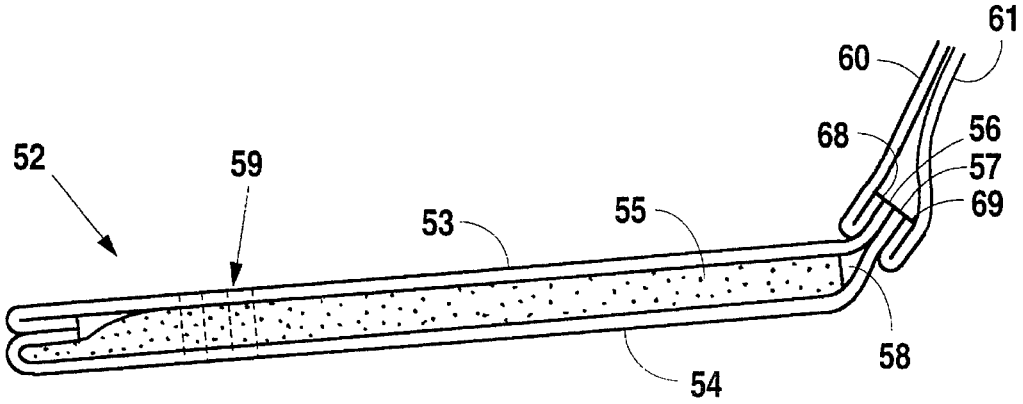
FIG. 5 is a side plan view taken in cross-section along lines 5,5 illustrating the brim of the reversible hat of the second embodiment.

As illustrated in FIGS. 3–5, reversible hat 50 of the second embodiment includes crown 51, brim 52, and elastic band 70. In this second embodiment, crown 51 and brim 52 are fashioned from any suitable material such as cloth. Brim 52 includes brim sections 53 and 54 having brim stiffener 55 therebetween (see FIG. 5). Brim section 53 is typically a color different from brim section 54 to make hat 50 reversible. To form brim 52, the edges of brim sections 53 and 54 are stitched together, however, edge 56 of brim section 53 and edge 57 of brim section 54 remains unstitched. After brim sections 53 and 54 have been stitched together, they are turned inside out to place the stitching and excess material to the interior and to create opening 58 therebetween. To complete brim 52, brim stiffener 55 is inserted through opening 58, and stitching referenced generally with numeral 59 is stitched to secure brim stiffener 55 within brim sections 53 and 54. In this second embodiment, brim stiffener 55 is a flexible plastic piece that shapes to provide a curved brim in either position of reversible hat 50.

Crown 51 includes cover portions 60 and 61. Cover sections 62–67 are stitched together to form cover portion 60 which is circular in shape as depicted in FIGS. 3 and 4. Cover sections that are identical in shape to cover sections 62–67 are stitched together to fashion cover portion 61 which is also circular in shape. The color of cover portion 60 typically is the same as brim section 53, while the color of cover portion 61 is the same as brim section 54.

Cover portion 60 is attached to brim 52 by placing cover portion 60 adjacent to brim section 53 and stitching edge 56 of brim section 53 to edge 68 of cover section 60. Similarly, cover portion 61 is placed adjacent to brim section 54 and edge 57 of brim section 54 is stitched to edge 69 of cover portion 61.

After the stitching of brim 52 to cover portions 60 and 61, cover portions 60 and 61 are stitched together until the cut-out segment of cover section 65 and the cut-out segment of the cover section of cover portion 61 adjacent to cover section 65 are reached. At this point, cover portions 60 and 61 are turned inside out with brim 52 passing through the unstitched cut-out segments of cover section 65 and the corresponding cover section of cover portion 61. The turning inside out of cover portions 60 and 61 exposes brim 52 and hides the stitching and excess material between cover portions 60 and 61 and between brim 52 and cover portions 60 and 61. Once cover portions have been turned inside out, the cut-out segments of cover section 65 and the corresponding cover section of cover portion 61 are stitched together to finish the stitching of cover portions 60 and 61 together.

Elastic band 70 is then sewn between the cut-out segments of crown section 65 and the corresponding cover section of cover portion 61. In this second embodiment, elastic band 70 includes a flexible rubber band-like material sewn between two pieces of fabric. One piece of the fabric matches the color of cover portion 60, while the other piece of fabric matches the color cover portion 61. The elasticity of elastic band 70 provides the one size fits all feature of reversible cap 50. That is, the elastic band 70 expands so that reversible cap 50 will fit the head of a wearer regardless of the wearer's hat size. Although the present invention has been described in terms of the foregoing embodiment, such description has been for exemplary purposes only and, as will be apparent to one of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A reversible hat, comprising:

a first crown portion;

a second crown portion stitched to said first crown portion;

a first brim section;

a second brim section stitched to said first brim section;

a brim stiffener stitched between said first brim section and said second brim section;

said first brim section stitched to said first crown portion and said second brim section stitched to said second crown portion; and an elastic band that permits the expansion of said first and second crown portions to allow said reversible hat to fit the head of any wearer wherein said elastic band is stitched to one of said first and second brim sections and resides between said first and second crown portions.

2. The reversible hat according to claim 1 wherein said first and second brim sections encircle said first and second crown portions.

3. The reversible hat according to claim 1 wherein said first and second crown portions each comprise a tip and a cover.

4. The reversible hat according to claim 1 wherein said first and second brim sections each comprise a pair of brim portions.

* * * * *